US011143449B2

(12) United States Patent
Nylykke

(10) Patent No.: US 11,143,449 B2
(45) Date of Patent: Oct. 12, 2021

(54) METHOD FOR DEHUMIDIFYING A REFRIGERATION SYSTEM

(75) Inventor: Morten Nylykke, Graasten (DK)

(73) Assignee: MAERSK CONTAINER INDUSTRY A/S, Tinglev (DK)

( * ) Notice: Subject to any disclaimer, the term of this patent is extended or adjusted under 35 U.S.C. 154(b) by 1406 days.

(21) Appl. No.: 12/858,228

(22) Filed: Aug. 17, 2010

(65) Prior Publication Data

US 2011/0041539 A1 Feb. 24, 2011

(30) Foreign Application Priority Data

Aug. 20, 2009 (DK) ..... PA 2009 00944

(51) Int. Cl.
*F25D 21/00* (2006.01)
*F25D 17/04* (2006.01)

(52) U.S. Cl.
CPC ..... *F25D 17/042* (2013.01); *F25B 2700/02* (2013.01); *F25B 2700/2117* (2013.01); *F25D 2317/0411* (2013.01); *F25D 2317/04131* (2013.01); *F25D 2400/02* (2013.01)

(58) Field of Classification Search
CPC ..... F25D 21/08; F25D 21/00; F25D 17/042; F25D 2317/0411; F25D 2317/04131; F25D 2400/02; F25B 1/00; F25B 2700/2117; F25B 2700/02; F24F 3/14; F24F 3/153; F24F 3/1405
USPC .... 62/176.1, 276, 277, 90, 93, 176.3, 176.6, 62/156, 186, 271
See application file for complete search history.

(56) References Cited

U.S. PATENT DOCUMENTS 3,831,663 A * 8/1974 Pithie ..... F24F 3/153 165/263
4,291,542 A 9/1981 Sminge et al.
4,350,021 A * 9/1982 Lundstrom ..... 62/150
4,843,833 A * 7/1989 Polkinghorne ..... 62/180
5,119,571 A 6/1992 Beasley
5,129,234 A * 7/1992 Alford ..... 62/176.6
5,353,862 A * 10/1994 Akiyama ..... F24F 3/14 165/229
5,578,753 A * 11/1996 Weiss et al. ..... 73/335.02
(Continued)

FOREIGN PATENT DOCUMENTS

DE 197 28 578 A1 2/1999
DE 102 28 334 A1 1/2004
(Continued)

*Primary Examiner* — Harry E Arant
(74) *Attorney, Agent, or Firm* — EIP US LLP

(57) ABSTRACT

A method for dehumidifying a refrigeration system especially to dehumidify a refrigerated transporting container is disclosed. The refrigeration system includes a refrigeration circuit including an evaporator, a compressor, an expansion valve and a condenser. The refrigeration system also includes a control unit and a cooling space, the evaporator is placed in the cooling space and air blows over the evaporator to be cooled down. The dehumidification method is stepwise, and the method includes a dehumidification mode and a re-establish mode. During the dehumidifying process the system shifts between the dehumidification mode and a re-establish mode stepwise dehumidifying the air in the container in such a way that the measured parameters especially the compartment temperature stays within acceptable limits.

9 Claims, 2 Drawing Sheets

(56) References Cited

U.S. PATENT DOCUMENTS

| | | | | | |
|---|---|---|---|---|---|
| 6,029,466 | A | * | 2/2000 | Wieszt | 62/227 |
| 6,035,649 | A | * | 3/2000 | Straub | F24F 11/70 62/93 |
| 6,070,110 | A | * | 5/2000 | Shah et al. | 700/278 |
| RE37,630 | E | * | 4/2002 | Behr | 62/80 |
| 6,763,677 | B1 | | 7/2004 | Burchill et al. | |
| 2007/0209374 | A1 | * | 9/2007 | Konopa | 62/150 |
| 2008/0156891 | A1 | * | 7/2008 | Zhou et al. | 236/44 C |
| 2008/0196427 | A1 | * | 8/2008 | Bianchi et al. | 62/176.6 |
| 2009/0151378 | A1 | | 6/2009 | Kawakatsu et al. | |
| 2009/0230202 | A1 | * | 9/2009 | Matsui et al. | 236/44 A |

FOREIGN PATENT DOCUMENTS

| | | | | |
|---|---|---|---|---|
| DE | 102 35 781 | A1 | | 3/2004 |
| DE | 103 26 329 | A1 | | 12/2004 |
| DE | 10 2008 051 748 | A1 | | 4/2010 |
| JP | 60036839 | A | | 2/1985 |
| JP | H03-279727 | A | | 12/1991 |
| JP | 1999-159928 | A | * | 6/1999 |
| JP | 2000-274916 | A | | 10/2000 |

* cited by examiner

METHOD FOR DEHUMIDIFYING A REFRIGERATION SYSTEM

CROSS REFERENCE TO RELATED APPLICATION

Applicant hereby claims foreign priority benefits under U.S.C. § 119 from Danish Patent Application No. PA 2009 00944 filed on Aug. 20, 2009, the contents of which are incorporated by reference herein.

FIELD OF THE INVENTION

The present invention relates to a dehumidifier for dehumidifying a cooling compartment in a refrigeration system especially for dehumidifying a refrigerated transportation container and a method for controlling the dehumidifying process using an economically optimized method to control the humidity in a closed cooled room by controlling the capacity of an evaporator.

BACKGROUND OF THE INVENTION

A common method to dehumidify air is to blow air over a cold evaporator with the temperature of the evaporator surface maintained below the frost point so the moisture in the air will deposit on the evaporator coils and freeze to ice. The ice then is removed from time to time by defrosting.

U.S. Pat. No. 4,291,542 shows an air drying apparatus comprising a refrigeration system, the evaporator of which is used for cooling an air flow to or below its dew point whereby the moisture in the air as drawn through the cooler by a fan is condensed on the cooler and drained off. The cooler can temporary be connected as a condenser whereby the cooler is heatable for defrosting. A temperature sensor mounted on the cooler serves to control the fan power for optimal economy in normal operation and to detect frost formation and control start stop of a defrosting cycle.

The problem of common humidifiers is that the surface temperature often is lower than it has to be and therefore is not economically and that the dehumidifying process causes disturbances in the refrigeration system, especially critical is disturbance of the cooling of the goods in the cooling compartment of the refrigerator.

SUMMERY OF THE INVENTION

It is the object of the invention to make a dehumidifier for a cooling compartment especially for a refrigerated transportation container and a method to control the dehumidifier to remove moisture from the air in an economical optimized manner.

It is further the object of the invention during the dehumidifying process to keep the parameters of the refrigeration system, especially the temperature in the cooling compartment within acceptable limits so the dehumidifying process do not damage the goods in the cooling compartment during dehumidification.

It is further the object of the invention to de-ice the evaporator whenever needed during the dehumidification process.

The refrigeration system can be operated in three different ways; Normal operation, dehumidification and defrosting. During normal operation the refrigeration system works like any normal refrigeration system, when cooling is needed refrigerant is let into the evaporator and air is blown over the evaporator and is cooled down.

The invention provides a method for dehumidifying the air in a cooling compartment, for instance in a container in an economically optimized manner and in a way that keeps the measured parameters of the refrigeration system, especially the temperature in the cooling compartment within acceptable limits during dehumidification.

The refrigeration system comprises a refrigeration circuit, a control unit, a cooling compartment, a re-establish mode and a dehumidification mode, a target air temperature, a target air moisture percentage; the refrigeration circuit comprises a compressor, an expansion valve, a condenser and an evaporator; the cooling compartment comprises a cooling space, and the cooling space comprises means to blow air through the cooling space, the evaporator, a temperature sensor placed close to the surface of the evaporator, a moisture sensor arranged upstream of the evaporator and heating elements arranged downstream of the evaporator.

The control unit comprises means to determine a first shift condition and a second shift condition, and the dehumidification method comprising the steps of:

a. enter the dehumidifying mode,
b. when a first shift condition is reached the refrigeration system shifts to re-establish mode,
c. when a second shift condition is reached the refrigeration system shifts to dehumidification mode,
d. the steps b-c is repeated until the target air moisture percentage is reached.

The advantage of this step wise dehumidification method, where there is shifts between dehumidification mode and re-establish mode, is that the measured parameters of the refrigeration system, especially the temperature in the cooling compartment is kept within acceptable limits. By regularly entering re-establish mode the parameters measured in the system, for instance the cooling compartment temperature can be checked, and if they are different from the preferred operation parameters, the system runs for a while in re-establish mode to re-establish the parameters to their preferred values. In this way the temperature in the cooling compartment can be kept basically within acceptable limits during dehumidification, so the goods in the cooling compartment are not damaged.

The cooling compartment comprises a cooling space, the cooling space are separated from the rest of the cooling compartment in such a way that no goods can be placed in the cooling space, so there is a free flow of air in the cooling space.

In the preferred embodiment the dehumidification mode comprises the steps of:

blowing air over the evaporator,
the moisture sensor measures the air moisture percentage and air temperature before the air reaches the evaporator,
determine a target surface temperature based on the measured air moisture percentage and air temperature,
regulate the surface temperature of the evaporator by controlling the refrigeration circuit so the surface temperature of the evaporator correspond to the chosen target surface temperature,
the heating elements warms up the air after it passed the evaporator.

By using the air moisture percentage and air temperature of the air before it reaches the evaporator to determine a target surface temperature to regulate the surface temperature of the evaporator, an economically optimized control of the process can be obtained. The target temperature is determined so it is not too low; a too low temperature will not be economically optimized, energy will be wasted. The temperature of the surface of the evaporator will be chosen such that it is cold enough to give an effective condensing; the surface temperature is chosen so the moisture percentage of the air, when it passes the evaporator and is cooled down, reached 100%. The temperature for which the moisture percentage reaches 100% is called the dew-point temperature. The surface temperature of the evaporator is kept a little lower than the dew-point temperature.

The heating elements placed downstream after the evaporator heats up the air just after the air passed the evaporator. This has the effect that when air has reached a moisture percentage of 100% the moisture condenses at the coldest surface. By having heating elements just after the evaporator it is ensured that the coldest surface is the evaporator, so the moisture condenses on the evaporator. A further advantage of having heating elements just after the evaporator is that the heating elements heats up the air before it returns to the cooling compartment, so by heating the air the moisture percentage of the air is lowered, so air with a lower moisture percentage is returned to the cooling compartment.

After the moisture condenses on the evaporator, it drains down in a tray placed in the bottom of the container below the evaporator.

The refrigeration system comprises means to determine the dew point temperature, when entering the dehumidification mode the dew point temperature is determined for air with the found moisture percentage and air temperature, and then a target surface temperature, lower than the dew point temperature, is determined.

To further improve the method, the dehumidification mode can further comprise the step of reducing the amount of refrigerant in the evaporator, so the evaporation takes place in the first part of the evaporator. The first part of the evaporator is to be understood as the part closed to the refrigerant inlet of the evaporator.

By reducing the amount of refrigerant evaporation occurs in the first part of the evaporator, this makes it easier to control the temperature of the surface of the evaporator, so it is easier to control the refrigeration system to reach the target temperature of the evaporator surface. The disadvantage of this is that by adding less of the refrigerant to the evaporator, the cooling of the air is less and therefore the temperature in the cooling compartment might rise. Therefore the method of entering the re-establish mode regularly becomes very important because the need to regularly re-establish the parameter values, like the cooling compartment temperature, increase. Likewise if the dehumidification takes place at a time, where cooling is not needed, the cooling compartment temperature will decrease and also in this case entering the re-establish mode regularly is important.

A simple embodiment to determine the target surface temperature is to choose the target surface temperature to be less than 10 degrees lower than the dew point temperature. The dew point temperature is calculated when the system goes into dehumidification mode, and then a number of degrees are subtracted from the dew point temperature to determine the target surface temperature.

This is a simple way to determine the target surface temperature; of course more complex algorithms can also be used. The basic idea is that the target surface temperature should not be to much lower than the dew point temperature, because that would be economically inefficient. However the target surface temperature should be so much lower than the dew point temperature that the dew point temperature does not drop to be lower than the target surface temperature before the system enters re-establish mode.

Conditions to determine when to shift from re-establish mode to dehumidification mode and visa-versa has to be defined either by the user or by the manufacturer and entered into the control unit.

One possible embodiment is that the conditions, called the second shift condition, for shifting from re-establish mode to dehumidification mode is that the air temperature is less than a preselected number of degrees different from the target air temperature. For instance if the temperature in the cooling compartment is within 0.5 degrees of the target air temperature, the conditions can be close enough to the preferred conditions, and the system can shift to dehumidification mode to continue dehumidifying.

Likewise a possible embodiment is that the first shift condition, to shift from dehumidification mode to re-establish mode, is when the air temperature is more than a preselected number of degrees different from the target air temperature. This preselected number of degrees can for instance be a difference of 5° C.

Another possible embodiment is that the first shift condition, to shift from dehumidification mode to re-establish mode, is after a preselected time period. Instead of using the temperature or another measure parameter to decide when to go into re-establish mode, re-establish mode can be entered after running dehumidification mode for a certain time period.

The control unit can be set to start the dehumidification method, when the relative humidity RH, (based on actual value from RH sensor), percentage is higher than a predefined value. Another possibility is that the dehumidification can be initiated manually.

When the evaporator surface temperature drops below the freezing point, ice can assemble on the evaporator coils, therefore defrosting can be necessary. Defrosting is performed to remove ice from the evaporator, the method comprising the steps of:

the heating elements are turned on, turning off the means to blow air over the evaporator, when the ice is removed from the evaporator and the evaporator temperature $T_{evap}$ is above 20° C., previous operation resumes.

Usually defrosting takes place as part of the re-establish mode.

DETAILED DESCRIPTION OF THE DRAWINGS

Figure 1:
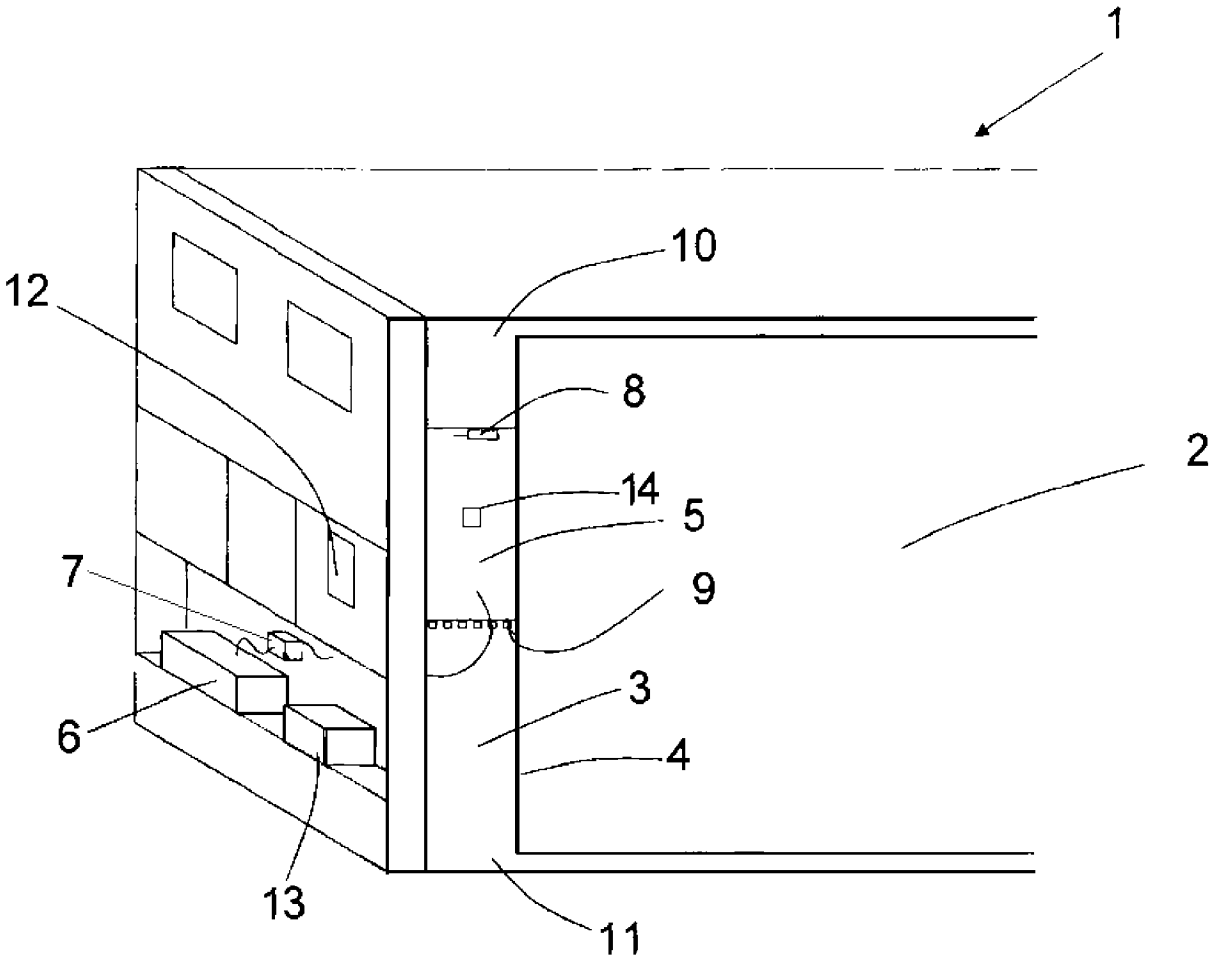
FIG. 1 shows an embodiment of this invention, it is a transport container with the dehumidification system.

FIG. 1 shows a transport container 1 with is the preferred embodiment of this invention. The container 1 comprises a cooling compartment 2 and a cooling space 3. The cooling space 3 is separated from the rest of the cooling compartment by a plate 4. In the cooling space 3 is placed an evaporator 5. The rest of the refrigeration circuit is placed outside the container, in FIG. 1 is shown the compressor 6, the expansion valve 7 and the condenser 13. The cooling space 3 comprises means to blow air through the cooling space 3, the evaporator 5, a temperature sensor 14 placed close to the surface of the evaporator 5, a moisture sensor 8 arranged upstream of the evaporator 5 and heating elements 9 arranged downstream of the evaporator 5. In the cooling space 3 beside the evaporator 5 is placed the moisture sensor 8 and heating elements 9. In the ends of the cooling space 3 is an air inlet 10 and in the other end is an air outlet 11. And outside the container is a control unit 12.

In this case the cooling space 3 is an air channel build into the cooling compartment 2. The cooling space 3 can be a part of the container 1 or it can in an alternative embodiment be a separate unit mounted into the cooling compartment 2.

At the air inlet 10 there are means to blow air into the cooling space 3; this could for instance be a fan. The moisture sensor 8 is placed upstream of the evaporator 5, so the air passes the moisture sensor 8 before it reaches the evaporator 5. The moisture sensor 8 measures the moisture percentage and the air temperature. The heating elements 9 are placed downstream from the evaporator 5, so the air reaches the heating elements 9 just after the air passed the evaporator 5.

Figure 2:
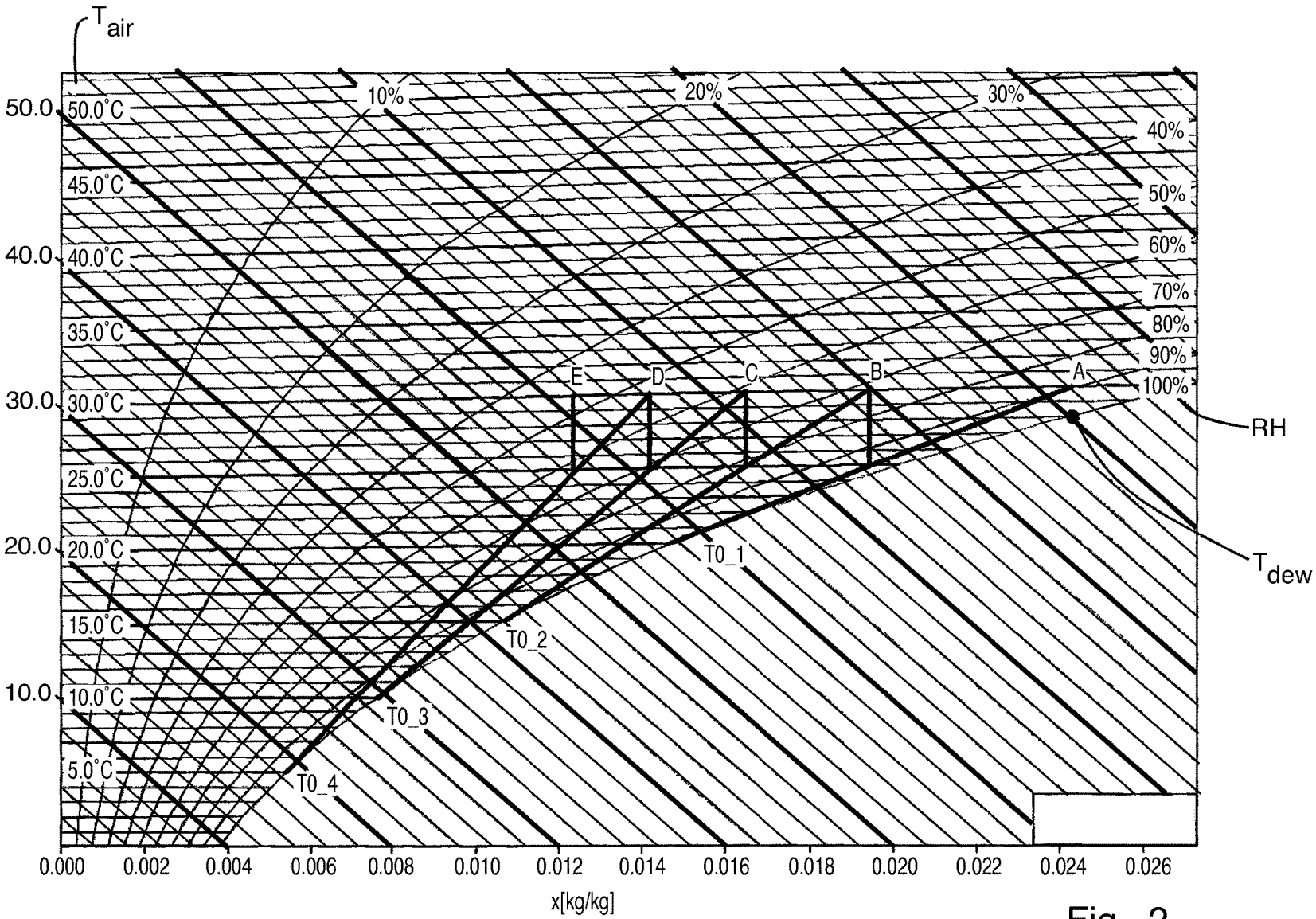
FIG. 2 shows an I,x-diagram displaying an example of how the dehumidifying method runs.

FIG. 2 is an I,x-diagram for moist air at 1013 mBar. The diagram can also be called a h,x-diagram or a Mollier chart. On the left side is air temperature $T_{air}$, the horizontal lines follows the air temperature. On the right side the relative moisture RH percentage is following the curved lines. The temperatures following the slanting lines are not relevant for this invention. The x-axis of the diagram shows the moisture content in the unit [kg water/kg air]. The y-axis shows the Enthalpy, the Enthalpy is represented by the air temperature $T_{air}$.

The dehumidification process is initiated at the point A and the dehumidification mode is started. The air temperature in the container is 30° Celsius and the humidity is 90%. Going from point A vertically down to the 100% moisture line, the dew point temperature $T_{dew}$ is found to be 28° C. Now the target surface temperature T0 of the evaporator surface is by the control unit 12 chosen to be T0_1, which is 20° C. It is important that the T0 is lower than the found dew point temperature $T_{dew}$, so a moisture percentage of 100% is reached for the air passing the surface of the evaporator. The air passing close to the evaporator then cannot hold all the moisture in the air, and therefore moisture condenses on the surface of the evaporator.

After a while the air temperature has dropped to 25° C. Then a first shift condition is reached, and the system shifts to re-establish mode. The refrigeration system is now operated in such a way that the air temperature increases to the target temperature of 30° C. reaching point B in FIG. 2. Now the moisture percentage in the container has dropped to 72%. Reaching point B triggers a second shift condition and the system shifts back to dehumidification mode. A new target temperature for the evaporator surface is chosen. In this embodiment the algorithm used by the control unit 12 chooses the new target temperature T0_2 simply to be 5° C. less than the previous target temperature.

So the surface temperature of the evaporator is now lowered to T0_2, which is 15° C. The air temperature is now slowly dropping and when it has dropped 5° C., again the system shifts to re-establish mode and the temperature is increase to the target temperature of 30° C. reaching point C, where the moisture percentages is now dropped to 60%.

The procedure continues through two more steps eventually reaching point E, where the moisture percentages is dropped to lower than 50%, the target percentage is reached and the dehumidification process stops.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A dehumidification method for a refrigeration system, the refrigeration system comprises a refrigeration circuit, a control unit, a cooling compartment, a target air temperature, a target air moisture percentage;

wherein the refrigeration circuit comprises:
- a compressor,
- an expansion valve,
- a condenser,
- an evaporator;

wherein the cooling compartment comprises a cooling space for cooling air, which is separated from the rest of the cooling compartment and which defines an air flow channel for providing cooled air into the cooling compartment, the cooling space comprising:
- means to blow air through the cooling space,
- the evaporator,
- a temperature sensor placed adjacent to the surface of the evaporator,
- a moisture sensor arranged upstream of the evaporator,
- heating elements arranged downstream of the evaporator;

wherein the control unit determines a first shift condition to shift from a dehumidification mode to a re-establish mode, and a second shift condition to shift from the re-establish mode to the dehumidification mode;

wherein the first shift condition to shift from dehumidification mode to re-establish mode is when an air temperature in the cooling compartment is more than a first preselected non-zero number of degrees Celsius different from the target air temperature; and the dehumidification method comprising the steps of:
- the control unit entering the refrigeration system into the dehumidification mode,
- the control unit shifting the refrigeration system to the re-establish mode when the first shift condition is reached,
- the control unit shifting the refrigeration system to the dehumidification mode when the second shift condition is reached,
- repeating the steps of shifting to the re-establish mode and shifting to the dehumidification mode until the target air moisture percentage is reached;

wherein the dehumidification mode comprises the steps of:
- blowing air over the evaporator,
- measuring with the moisture sensor an air moisture percentage and air temperature of air blown through the cooling space before the air reaches the evaporator,
- determining by the control unit a dew point temperature based on the measured air moisture percentage and air temperature of the air blown through the cooling space,
- determining by the control unit a target evaporator surface temperature that is lower than the dew point temperature,
- regulating by the control unit the surface temperature of the evaporator by controlling the refrigeration circuit so the surface temperature of the evaporator corresponds to the determined target evaporator surface temperature, and
- warming up the air with the heating elements after the air passes over the evaporator; and
- wherein, during repeating the steps of shifting to the re-establish mode and shifting to the dehumidification mode until the target air moisture percentage is reached, each target evaporator surface temperature determined by the control unit is lower than the preceding determined target evaporator surface temperature wherein the second shift condition to shift from re-establish mode to dehumidification mode is that an air temperature in the cooling compartment is less than a second preselected number of degrees Celsius different from the target air temperature, the second preselected number degrees being less than the first preselected numbers of degrees; and wherein during the re-establish mode the refrigeration system is operated so as to cause the air temperature in the cooling compartment to increase up toward, or decrease down toward the target air temperature.

2. The dehumidification method according to claim 1, wherein the dehumidification mode further comprises the steps of reducing the amount of refrigerant in the evaporator so the evaporation takes place in the first part of the evaporator.

3. The dehumidification method according to claim 1, wherein the chosen target evaporator surface temperature is less than 10° C. lower than the dew point temperature.

4. The dehumidification method according to claim 1, wherein dehumidification starts when the air moisture percentage is higher than a predefined value.

5. The dehumidification method according to claim 1, wherein dehumidification starts when it is manually activated.

6. The dehumidification method according to claim 1, wherein defrosting is performed to remove ice from the evaporator, the method comprising the steps of:

turning on the heating elements, and turning off the means to blow air over the evaporator, resuming previous operation when the ice is removed from the evaporator and the evaporator temperature $T_{evap}$ is above 20° C.

7. The dehumidification method according to claim 1, wherein the target air moisture percentage is reached via the control of superheat in the refrigeration system during the dehumidification mode.

8. A dehumidification method for a refrigeration system of a transport container, the refrigeration system comprising a refrigeration circuit, a control unit, a cooling compartment, a target air temperature, and a target air moisture percentage;

wherein the refrigeration circuit comprises a compressor, an expansion valve, a condenser, and an evaporator;

wherein the cooling compartment comprises a cooling space for cooling air, which is separated from the rest of the cooling compartment and which defines an air flow channel for providing cooled air into the cooling compartment, the cooling space comprising means to blow air through the cooling space, the evaporator, a temperature sensor placed adjacent to the surface of the evaporator, a moisture sensor arranged upstream of the evaporator, and heating elements arranged downstream of the evaporator;

wherein the control unit determines a first shift condition to shift from a dehumidification mode to a re-establish mode, and a second shift condition to shift from the re-establish mode to the dehumidification mode;

wherein the first shift condition to shift from dehumidification mode to re-establish mode is when an air temperature in the cooling compartment is more than a first preselected non-zero number of degrees Celsius different from the target air temperature; and the dehumidification method comprising the steps of:

the control unit entering the refrigeration system into the dehumidification mode, the control unit shifting the refrigeration system to the re-establish mode when the first shift condition is reached, the control unit shifting the refrigeration system to the dehumidification mode when the second shift condition is reached, repeating the steps of shifting to the re-establish mode and shifting to the dehumidification mode until the target air moisture percentage is reached;

wherein the dehumidification mode comprises the steps of:

blowing air over the evaporator, measuring with the moisture sensor an air moisture percentage and air temperature of air blown through the cooling space before the air reaches the evaporator, determining by the control unit a dew point temperature based on the measured air moisture percentage and air temperature of the air blown through the cooling space, determining by the control unit a target evaporator surface temperature that is lower than the dew point temperature, regulating by the control unit the surface temperature of the evaporator by controlling the refrigeration circuit so the surface temperature of the evaporator corresponds to the determined target evaporator surface temperature, and warming up the air with the heating elements after the air passes over the evaporator; and wherein, during repeating the steps of shifting to the re-establish mode and shifting to the dehumidification mode until the target air moisture percentage is reached, each target evaporator surface temperature determined by the control unit is lower than the preceding determined target evaporator surface temperature wherein the second shift condition to shift from re-establish mode to dehumidification mode is that an air temperature in the cooling compartment is less than a second preselected number of degrees Celsius different from the target air temperature, the second preselected number degrees being less than the first preselected numbers of degrees; and wherein during the re-establish mode the refrigeration system is operated so as to cause the air temperature in the cooling compartment to increase up toward, or decrease down toward the target air temperature.

9. The dehumidification method according to claim 8, wherein the target air moisture percentage is reached via the control of superheat in the refrigeration system during the dehumidification mode.

* * * * *